US009447631B2

(12) United States Patent
Christie

(10) Patent No.: US 9,447,631 B2
(45) Date of Patent: Sep. 20, 2016

(54) PET DOOR ASSEMBLY

(76) Inventor: Malcolm Robert Christie, Arundel Hills (AU)

( * ) Notice: Subject to any disclaimer, the term of this patent is extended or adjusted under 35 U.S.C. 154(b) by 1292 days.

(21) Appl. No.: 11/353,756

(22) Filed: Feb. 14, 2006

(65) Prior Publication Data

US 2006/0179719 A1 Aug. 17, 2006

Related U.S. Application Data

(60) Provisional application No. 60/652,547, filed on Feb. 14, 2005.

(51) Int. Cl.
*E05D 15/48* (2006.01)
*E06B 7/32* (2006.01)

(52) U.S. Cl.
CPC ..... *E06B 7/32* (2013.01)

(58) Field of Classification Search
USPC ..... 49/169, 170, 504, 505; 160/116, 180, 160/381
See application file for complete search history.

(56) References Cited

U.S. PATENT DOCUMENTS 2,860,700 A * 11/1958 Horton ..... 160/180
3,553,891 A * 1/1971 Casebolt et al. ..... 49/505
3,583,466 A * 6/1971 Dreyer ..... 160/351
3,642,310 A * 2/1972 Hudson ..... 403/219
3,985,174 A * 10/1976 Bricker ..... 160/180
4,053,007 A 10/1977 Griffith
4,334,573 A * 6/1982 Hackman et al. ..... 160/180
4,453,346 A * 6/1984 Powell et al. ..... 49/404
4,603,724 A 8/1986 Borwick
4,754,797 A * 7/1988 Sronce ..... 160/354
4,782,630 A * 11/1988 Kleyn ..... 49/505
5,117,890 A 6/1992 Taylor et al.
5,269,097 A * 12/1993 Davlantes ..... 49/169
5,287,654 A * 2/1994 Davlantes ..... 49/169
5,473,853 A * 12/1995 Guillemet et al. ..... 52/745.16
5,535,804 A * 7/1996 Guest ..... 160/180
D374,488 S * 10/1996 Wang ..... D25/124
5,581,940 A * 12/1996 Peterson ..... 49/169
5,657,592 A * 8/1997 Davlantes ..... 52/206
5,701,813 A * 12/1997 Smith ..... 160/180
5,735,079 A * 4/1998 Davlantes ..... 49/169
5,967,215 A 10/1999 Needham et al.

(Continued)

FOREIGN PATENT DOCUMENTS

AU 759436 B2 11/1999

OTHER PUBLICATIONS http://www.biovets.com/screen_door_pet_3219_prd1.htm; pp. 1-2; "Biovets" website; Nov. 26, 2004.
http://www.moorepet.com/moorepet/index.cfm?fuseaction=customer.category&category_code=hspdscreen; pp. 1-5; "Moorepet" website; Nov. 26, 2004.

(Continued)

*Primary Examiner* — Jerry Redman
(74) *Attorney, Agent, or Firm* — Michael Haynes PLC; Michael N. Haynes

(57) ABSTRACT

A pet door assembly that includes a support structure that defines an access opening through which a pet can pass. A connecting arrangement is positioned on the support structure to permit the support structure to be connected to at least one connector fastenable to an inwardly facing surface of a closure frame. A self-closing door is mounted on the support structure to be displaceable between a closed position in which the door closes the access opening and an open position.

2 Claims, 6 Drawing Sheets

(56) References Cited

U.S. PATENT DOCUMENTS

| | | | | |
|---|---|---|---|---|
| 6,345,946 | B1 * | 2/2002 | Mainini et al. | 411/508 |
| 6,385,909 | B1 * | 5/2002 | Marsh et al. | 49/169 |
| 6,681,524 | B1 * | 1/2004 | Tillson | 49/169 |
| 6,681,833 | B2 * | 1/2004 | Wylie | 160/381 |
| 6,886,300 | B2 * | 5/2005 | Hudoba et al. | 52/222 |
| 7,210,513 | B2 * | 5/2007 | Goldenberg et al. | 160/31 |
| 2007/0295461 | A1 * | 12/2007 | Kim | 160/381 |

OTHER PUBLICATIONS http://www.petdoors.com/simple_screen_mounts.htm; pp. 1-7; "Petdoors" website; Nov. 26, 2004.

http://www.petsafe.net/pet doors/pet screen door.htm; pp. 1-2; "Petsafe" website; Nov. 26, 2004.

http://shop.petmarket.com/petscreendoor.html; pp. 1-3; "Petmarket" website; Nov. 26, 2004.

* cited by examiner

PET DOOR ASSEMBLY

This application claims the benefit of priority based on Provisional Application No. 60/652,547 entitled "A Pet Door Assembly," filed Feb. 14, 2005.

FIELD OF THE INVENTION

This invention relates to a pet door assembly. More particularly, this invention relates to a pet door assembly, to a kit for a pet door assembly and to an accessory for a pet door assembly. This invention finds particular application to screen doors, but would have other applications as well.

BACKGROUND OF THE INVENTION

Pet door assemblies are well known. They usually include a frame mounted in an existing closure and a closure member or flap that can be urged open by the pet. The closure member is mounted on the frame to be displaced, either by gravity or a spring, back into a closed position, once the pet has passed through an opening defined by the frame.

In U.S. Pat. No. 3,985,174, published Oct. 12, 1976, there is described a pet door that is installed in a window screen or screen door. In this patent, the frame of the pet door is fastened to a facing surface of a frame of the window screen or screen door. A problem with this arrangement is that the frame has to suit the dimensions of the window screen or screen door. In particular, a distance from the screen itself to the associated facing surface is critical. Furthermore, in the case of a sliding screen door, the frame could interfere with relatively sliding door members.

In U.S. Pat. No. 4,334,573, published Jun. 15, 1982, there is described a pet access door kit. This kit is essentially a frame that is fastened to a facing surface of the frame of a screen door. Screen material bounded by the frame is cut and a weight is fastened to the screen material so that the screen material defines a flap. This arrangement also has the problems of interference and limited adjustability described above.

In U.S. Pat. No. 5,701,813, published Dec. 30, 1997, there is described a pet door also for a screen door. As with the previous patents, this patent displays the same problems with a frame or mounting bracket being fastened to a facing surface of a frame of the screen door.

In some cases, for example in U.S. Pat. No. 5,535,804 published Jul. 16, 1996, the frame of the pet door is mounted directly on to the screen, without engagement with a frame of the window or screen door. Applicant submits that such an arrangement will not be able to withstand the rigors of day-to-day use, especially with energetic, larger dogs.

The Applicant is the proprietor of Australian patent no. 759436, the contents of which are hereby specifically incorporated by reference. This patent covers a pet door that is mountable in a security screen door commonly found in Australia. However, Applicant has found that such security screen doors are not generally found in the United States. Rather, a simple frame and screen arrangement appears to be predominant in the United States, particularly in the warmer areas. Applicant has developed the pet door of this Australian patent further in conceiving the present invention, so that the pet door can be used with conventional screen doors.

SUMMARY OF THE INVENTION

According to a first aspect of the invention, there is provided a pet door assembly which comprises a support structure that defines an access opening through which a pet can pass;

a connecting arrangement on the support structure to permit the support structure to be connected to at least one mounting member fastenable to an inwardly facing surface of a closure frame; and a self-closing door that is mounted on the support structure to be displaceable between a closed position in which the door closes the access opening and an open position.

According to a second aspect of the invention, there is provided a kit for a pet door assembly, the kit comprising at least one mounting member that is fastenable to an inwardly facing surface of a closure frame;

a support structure that is fastenable to the, or each, mounting member, the support structure defining an access opening through which a pet can pass; and a self-closing door that is mounted on the support structure to be displaceable between a closed position in which the door closes the access opening and an open position.

The kit may include one mounting member. The mounting member may be a connector having a first elongate portion and a second elongate portion oriented at right angles to the first portion. The connector may define openings to permit the connector to be fastened to said inwardly facing surface with fasteners received through the openings. Thus, the connector may be fastenable to a corner portion of the closure frame.

Instead of a single connector, the assembly may include two connectors. In this case each connector may be fastenable to respective frame members that define the corner portion of the closure frame.

The support structure may include a framework that defines the access opening. The framework may thus be connectable to the connector.

The framework may define a peripheral channel that opens outwardly. The connector may be at least partially receivable in the channel. Connecting formations may extend from the connector to engage complementary connecting formations in the channel.

The connecting formations may be interlocking ribs defined by the connector and by the framework in the peripheral channel. At least the connector may be of a resiliently flexible material to allow the framework to be urged on to the connector such that the ribs engage each other in an interlocking manner.

The invention finds particular, but not exclusive, application to screen doors. As is known, the closure frame of such doors is spanned by an insect screen.

Furthermore, the closure frame defines an inwardly facing surface adjacent the insect screen. In use, the connector is fastened to this surface.

It will be appreciated that the insect screen then extends over the access opening. The screen material that spans the access opening is cut away. An attaching arrangement may be positioned on an interior side of the framework to permit an inner peripheral portion of the screen material to be fastened to the interior side of the framework.

The self-closing door may include a flap member that is pivotally mounted in the framework.

According to a third aspect of the invention, there is described an accessory for a pet door assembly of the type described above, the accessory comprising at least one mounting member that is fastenable to a corresponding inwardly facing surface of a closure frame, a support structure of a pet door assembly being fastenable to the, or each, mounting member, the support structure defining an access opening through which a pet can pass.

According to a fourth aspect of the invention, there is provided an enclosure assembly which includes a number of wall members that are connectable to each other to define an enclosure;

a support structure that defines an access opening through which a pet can pass, mounted in one of the wall members so that the access opening opens into the enclosure; and a self-closing door that is mounted on the support structure to be displaceable between a closed position in which the door closes the access opening and an open position.

The invention is now described, by way of example, with reference to the accompanying drawings. The following description is intended to describe the best manner of performing the invention known to the Applicant at the time of filing the application. As such, the following description is not intended to limit the broad scope of the preceding paragraphs.

DETAILED DESCRIPTION OF THE INVENTION

Figure 1:
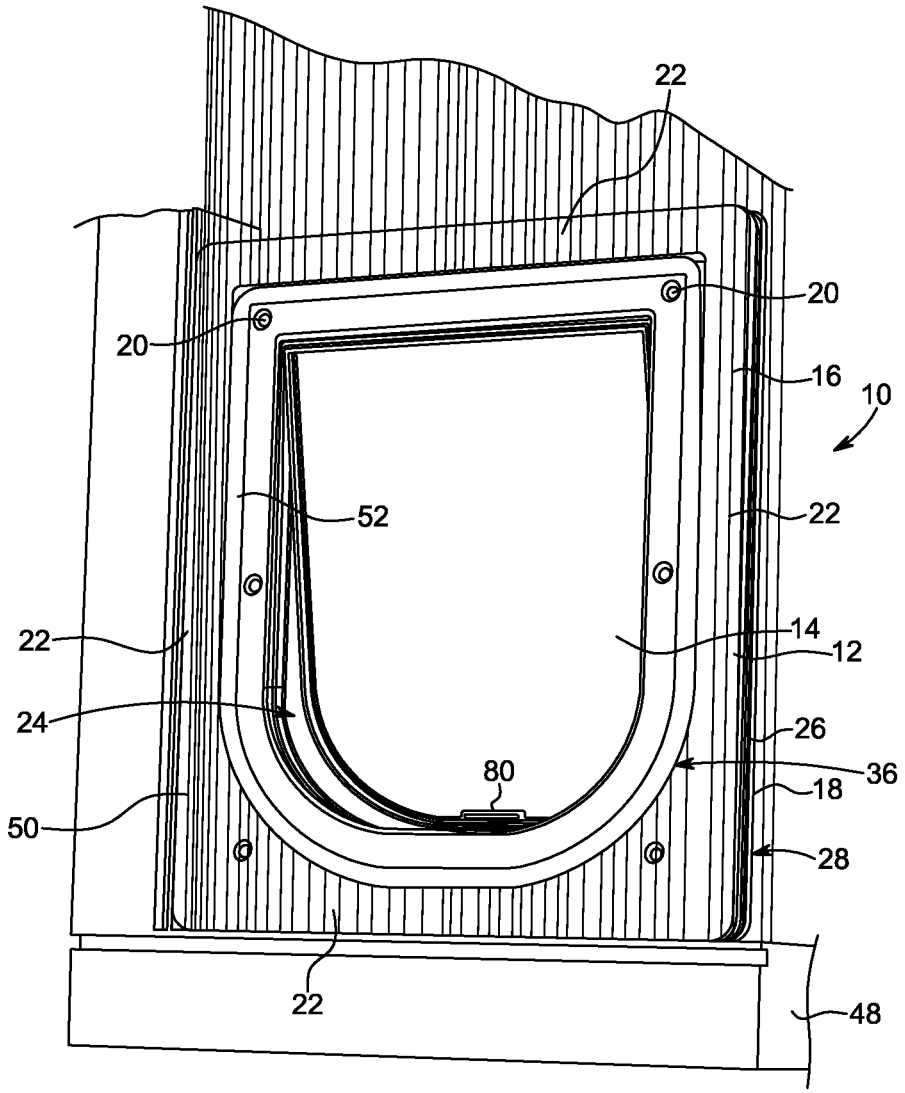
FIG. 1 shows a three-dimensional view of a pet door assembly, in accordance with the invention.

In FIG. 1, reference numeral 10 generally indicates a pet door assembly, in accordance with the invention.

The assembly 10 includes a support structure in the form of a frame 12. A flap 14 is mounted in the frame 12. The frame 12 has a generally rectangular shape with four side portions 22 defining an opening 24 through which a pet can pass. The flap 14, is pivotally mounted in the frame 19 to be pivotal between a closed position in which the flap 14 closes the opening 24 and an open position.

Figure 3:
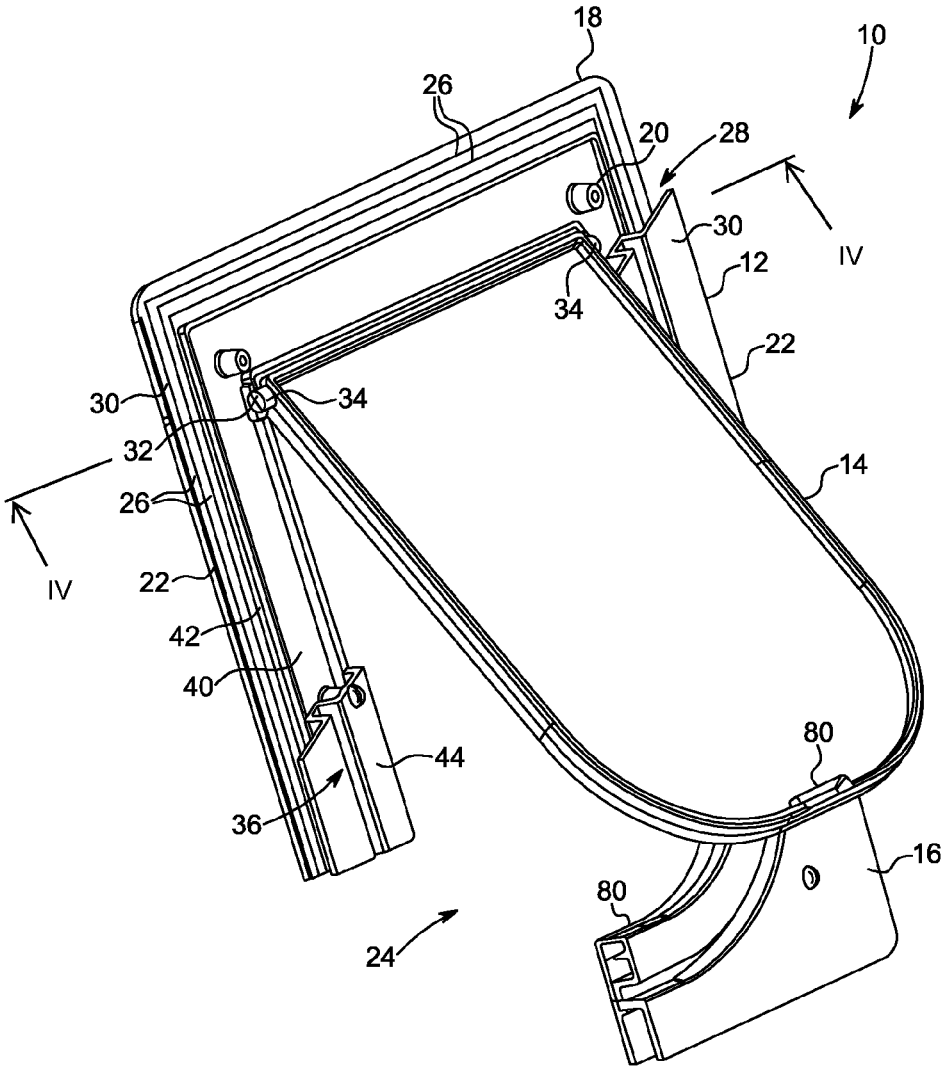
FIG. 3 shows a partly cut away view of the pet door assembly.
Figure 4:
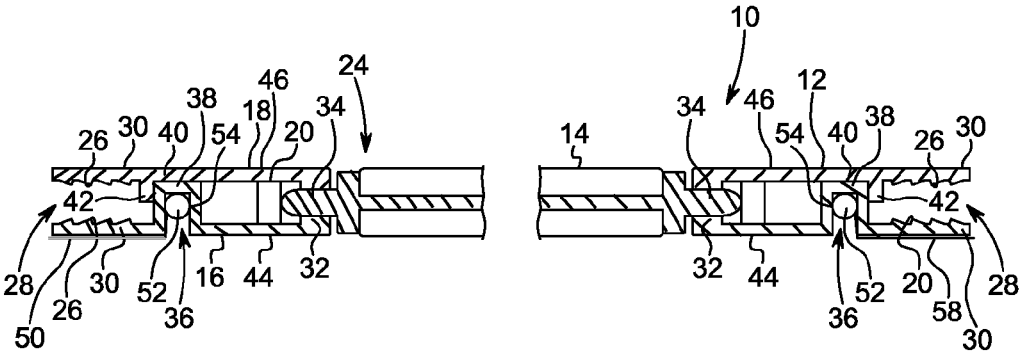
FIG. 4 shows a cross-sectioned view taken through section IV-IV in FIG. 3 of part of a frame of the pet door assembly.

In FIG. 3, there is shown a cut away view of the assembly 10 and in FIG. 4 there is shown a cross-sectional view of the frame 12 and flap 14 taken though a pivot axis of the flap 14. As can be seen, the frame 12 includes an interior frame member 16 and an exterior frame member 18 that are fastened together with fasteners, one of which is indicated at 20. An outer portion 30 of each frame member 16, 18 defines corresponding, longitudinally extending ribs 26 so that, when the frame members 16, 18 are fastened together, the ribs 26 extend into a channel 28 defined by the frame members 16, 18.

Both the frame members 16, 18 define a pair of corresponding opposed pivot formations 32 that retain respective pivot rods 34 of the flap 14 between respective corresponding pivot formations 32.

The interior frame member 16 has a channel portion 36 that extends about the frame 12 between the outer portion 30 and an inner portion 44 of the interior frame member 16. A floor 38 of the channel portion 36 bears against a portion 40 of the exterior frame member 18 interposed between the outer portion 30 and an inner portion 46 of the exterior frame member 18. The channel portion 36 is dimensioned to provide a suitable spacing between the corresponding outer portions 30, thereby to define a width of the channel 28.

The exterior member 18 defines a locating formation 42 to locate the channel portion 40 and thus the interior member 16 correctly relative to the exterior member 18.

In use, during installation, the frame 12 is fastened to a frame 48 of a screen door (see FIG. 1). An insect screen 50 is then cut along a line slightly inward of the channel portion 36. An elastomeric bead 52 is urged into the channel portion 36 to trap and retain an inner edge portion 54 of the screen 50 in the channel portion 36 and against the interior member 16.

Figure 2:
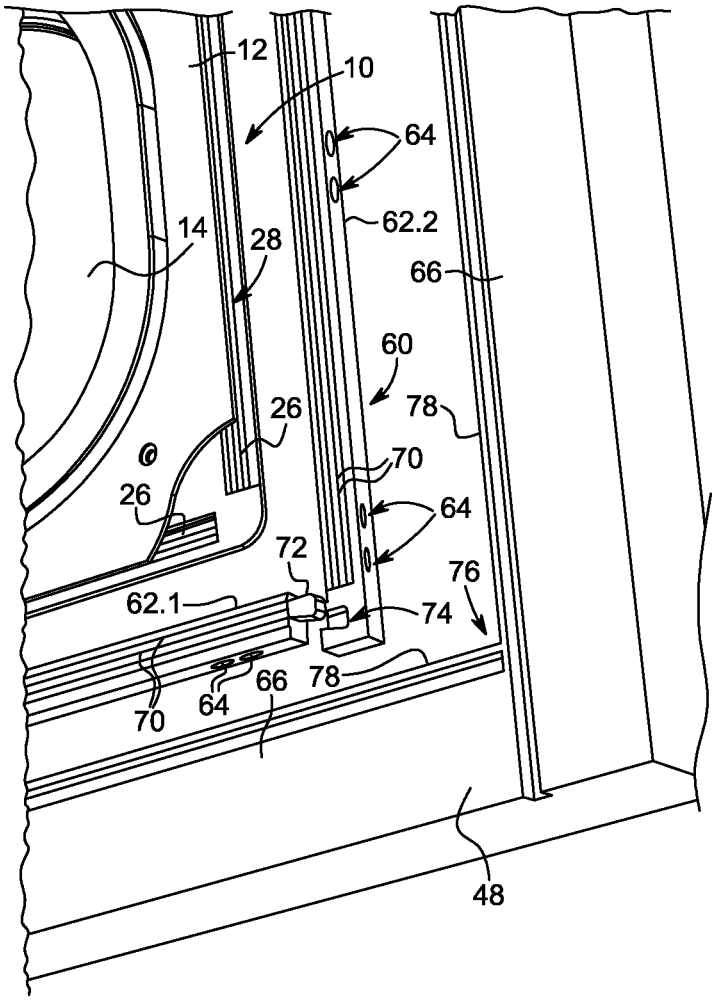
FIG. 2 shows a detailed view of part of the pet door assembly and an accessory, in accordance with the invention, for the pet door assembly.
Figure 5:
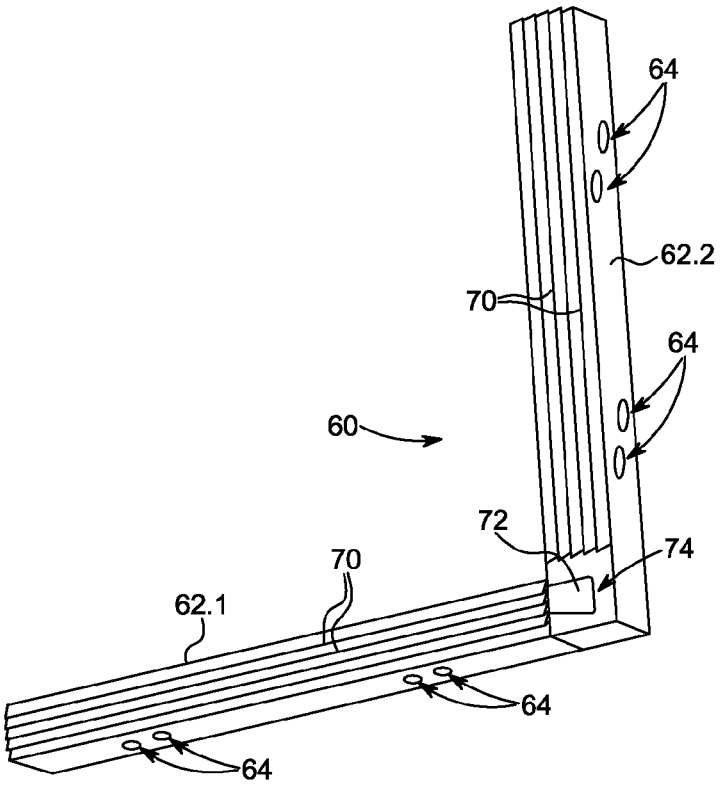
FIG. 5 shows a three dimensional view of the accessory for the pet door assembly.
Figure 7:
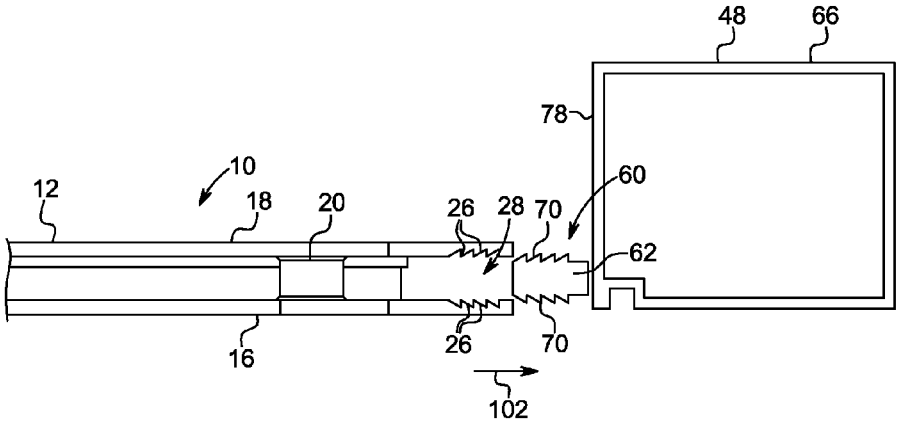
FIG. 7 shows a schematic view of part of the frame of the pet door assembly being mounted to the accessory of FIG. 5.

In FIGS. 2, 5 and 7, reference numeral 60 generally indicates an accessory, in accordance with the invention, for use with the pet door assembly 10.

The accessory 60 includes a pair of mounting members or connectors 62. Each connector 62 is an elongate extrusion of a plastics material. Each connector 62 has openings 64 to permit the connector 62 to be fastened to an inwardly facing surface 78 of a respective element 66 of the frame 48 of the screen door.

Each connector 62 defines a series of longitudinally extending ridges 70 that correspond with the ribs 26 of the frame members 16, 18. The ridges 70 and the ribs 26 are such that the connectors 62 can be clipped into respective channels 28 to retain the connectors 62 in the channels 28. In FIG. 7, an arrow 102 indicates a direction in which the assembly 10 is urged to clip the assembly 10 to one of the connectors 62.

The connectors 62 are mounted on respective corner elements 66 of the frame 48 (see FIG. 2). One of the connectors 62.1 has a spigot 72 that extends from an end of the connector 62.1. The other connector 62.2 defines a recess 74 in which the spigot 72 nests to retain the connectors 62 at right angles to each other.

In use, the connectors 62 are fastened to respective elements 66 at a corner 76, with the spigot 72 received in the recess 74. The frame 12 is then clipped to the connectors 62. The screen 50 is cut and secured as described above.

Corresponding magnetic elements 80 are positioned in a lower edge of the flap 14 and an adjacent portion of the frame 12. These serve to retain the flap 14 in a closed position.

It will be appreciated that by positioning the connectors 62 suitably, the pet door assembly 10 does not require customization for different screen doors. Furthermore, the connectors 62 are fastened to the inwardly facing surface 78 such that the connectors 62 or the frame 12 do not interfere with a complementary screen door in the case of glass sliding doors. Still further, since the connectors 62 are received in the respective channels 28, the pet door assembly 10 is inhibited from both upward and sideways movement. This provides a relatively rigid connection that can withstand use by energetic, larger pets.

Figure 6:
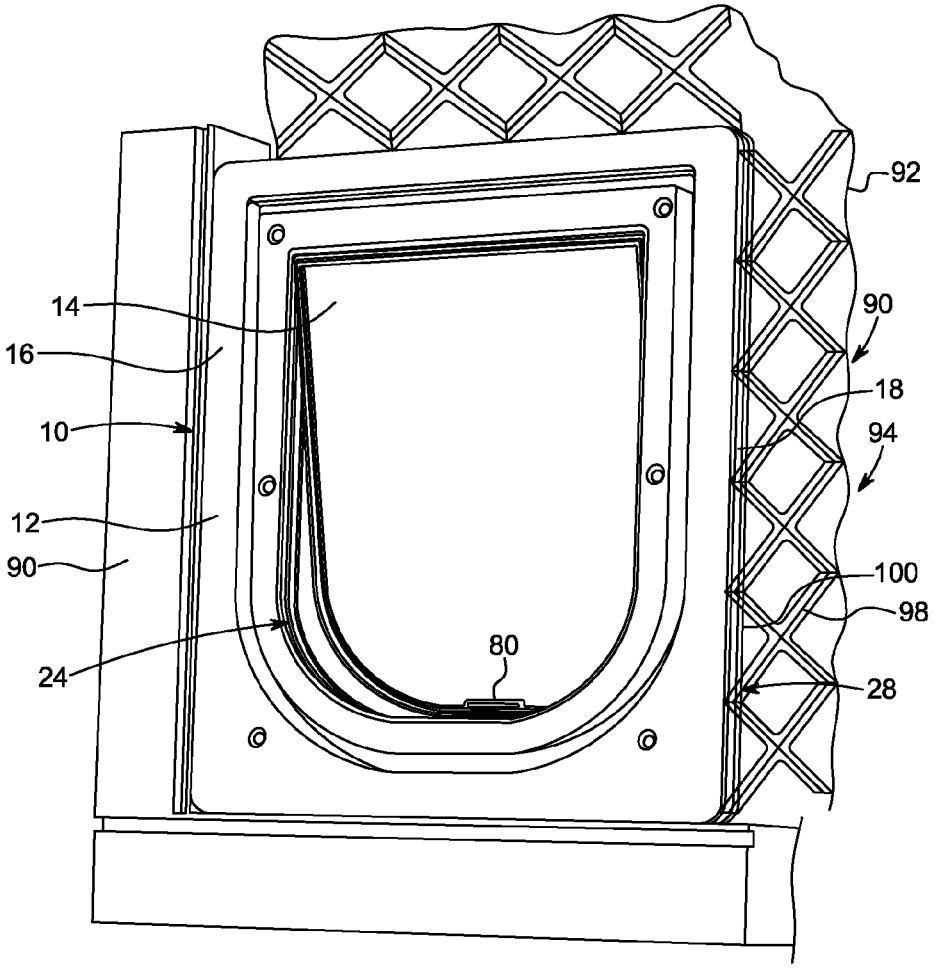
FIG. 6 shows part of a wall of a structural enclosure, in accordance with the invention, incorporating the pet door assembly.

In FIG. 6, reference numeral 90 generally indicates part of an enclosure structure, in accordance with the invention. With reference to FIGS. 1 to 5, like reference numerals refer to like parts, unless otherwise specified.

The enclosure structure 90 includes a number of wall members or walls 92. The walls 92 are connected together to define an enclosure 94. Each wall 92 has a frame 96 and a grille 98 mounted in the frame 96. The grille 98 is cut away to define an opening that accommodates the pet door assembly 10. The assembly 10 is received in the opening with an inner peripheral edge 100 defining the opening received in the channel 28.

The enclosure structure 90 can be one of those used to provide an enclosure for animals or children. Thus, a pet in the enclosure is able to enter and exit the enclosure without having to be lifted over one of the walls 92.

Applicant submits that the invention provides a convenient and simple pet door for a screen door. Of particular significance is the fact that the frame 12 is fastened to inwardly facing surfaces of a screen door frame. This inhibits interference in the case of glass sliding doors. Furthermore, the use of the connectors 62 provides a convenient manner of installing the pet door assembly 10. In particular, the use of the connectors 62 provides a means whereby a position of the closure assembly 10 can be adjusted to suit the particular screen door, without having to provide a customized closure assembly.

The invention claimed is:

1. A pet door assembly which comprises a substantially planar frame operatively adapted to define an access opening through which a pet can pass between an indoor space and an outdoor space and substantially through a substantially planar operatively moveable closure that is positioned in a closed closure position, the closure defining a plane that at least partially defines the indoor space and the outdoor space, the frame including an interior frame member adapted to be located adjacent the indoor space and an exterior frame member that is adapted to be located adjacent the outdoor space, the interior and exterior frame members adapted to cooperatively define a peripheral channel extending about the frame and opening in a direction substantially parallel to the plane of the closure, each frame member defining corresponding ribs that extend into the channel and away from that member's corresponding adjacent space;

a pair of elongate connectors adapted to be operatively fastened to, and to connect the frame to, respective planar surfaces of the closure that each extend perpendicular to the plane of the closure and cooperatively define an internal corner of a closure frame of the closure, the connectors each defining a series of longitudinally extending ridges that correspond with the ribs of the frame members, each connector being at least partially receivable in the channel, the ridges of each connector being configured to interlock with the ribs of the corresponding frame member when the connectors are urged into the channel; and a self-closing door that is operatively adapted to be mounted on the frame and to be displaceable between a closed position in which the self-closing door closes the access opening and an open position.

2. A pet door assembly as claimed in claim 1, in which the self-closing door includes a flap member that is pivotally mounted in the frame.

* * * * *